United States Patent [19]

Laskaris

[11] Patent Number: 4,516,405

[45] Date of Patent: May 14, 1985

[54] SUPPORTING TIE CONFIGURATION FOR CRYOSTAT FOR COLD SHIPMENT OF NMR MAGNET

[75] Inventor: Evangelos T. Laskaris, Schenectady, N.Y.

[73] Assignee: General Electric Company, Schenectady, N.Y.

[21] Appl. No.: 621,321

[22] Filed: Jun. 15, 1984

[51] Int. Cl.[3] ..... F17C 7/02

[52] U.S. Cl. ..... 62/55; 138/112; 138/114; 285/47; 285/DIG. 5

[58] Field of Search ..... 62/55, 514 R; 285/47, 285/DIG. 5; 138/112, 114; 220/437, 439, 901

[56] References Cited

U.S. PATENT DOCUMENTS

| | | | |
|---|---|---|---|
| 3,110,324 | 11/1963 | De Haan | 138/114 |
| 3,155,265 | 11/1964 | Reese | 220/437 |
| 3,326,244 | 6/1967 | Charles et al. | 138/114 |
| 3,351,224 | 11/1967 | Anderson | 138/114 |
| 3,485,272 | 12/1969 | Schmidt et al. | 138/112 |
| 3,706,208 | 12/1972 | Kadi et al. | 62/55 |
| 3,791,416 | 2/1974 | Zeimek et al. | 138/114 |
| 3,904,394 | 9/1975 | Prast et al. | 62/55 |

*Primary Examiner*—Ronald C. Capossela

*Attorney, Agent, or Firm*—Lawrence D. Cutter; James C. Davis, Jr.; Marvin Snyder

[57] ABSTRACT

A cryostat for use in magnets for NMR medical diagnostic imaging includes inner and outer vessels suspended by sets of at least three low thermal conductivity ties. The positioning of the tie anchoring points, particularly on the interior vessel, are selected in accordance with the present invention to preclude increased stresses in the supporting ties that occur as a result of thermal contraction. This configuration is particularly advantageous in that it permits the utilization of ties having smaller cross-sectional areas than would otherwise be required. The reduced cross-sectional area requirement is also therefore seen to increase the thermal isolation of the interior cryostat vessel. Cryostat vessels may be nested within one another.

5 Claims, 11 Drawing Figures

FIG. 7A
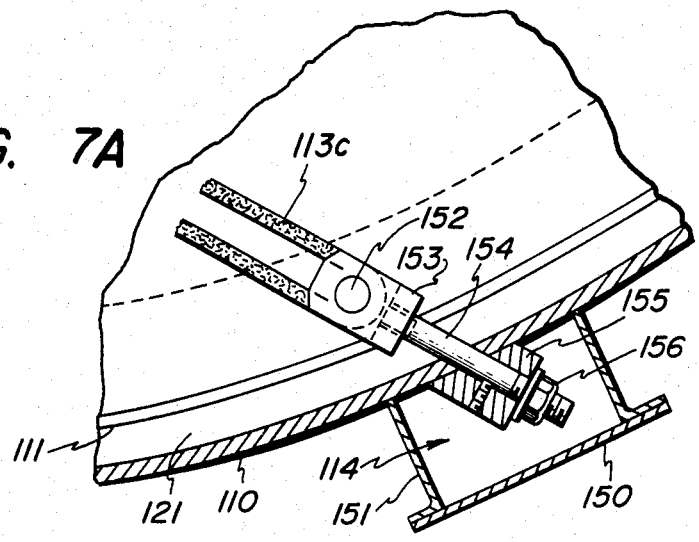
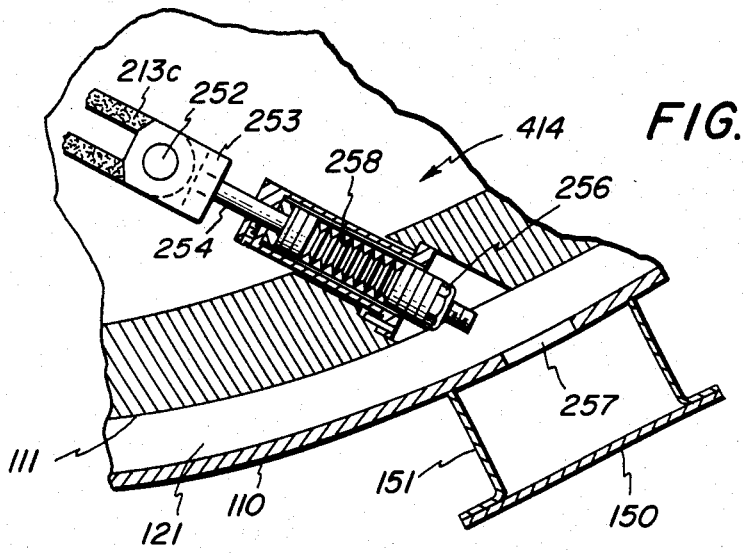
FIG. 7B
FIG. 7C
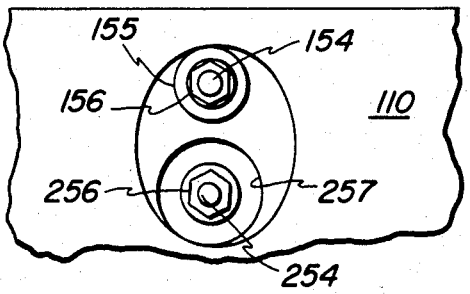

SUPPORTING TIE CONFIGURATION FOR CRYOSTAT FOR COLD SHIPMENT OF NMR MAGNET

BACKGROUND OF THE INVENTION

The present invention relates to cryostat construction and in particular it is related to the construction of cryostats which are employable in nuclear magnetic resonance (NMR) imaging systems and/or which contain superconducting coils which are cooled by a coolant fluid such as liquid helium. The present invention more particularly relates to a configuration of supporting ties which exhibit reduced cross-sectional area since thermal contraction stresses normally present have been effectively eliminated by the present configuration.

A cryostat is a containment vessel designed to thermally isolate its interior from exterior ambient temperature conditions. To achieve the desired degree of thermal isolation, multiple nested vessels may be employed with each vessel being designed to function at one of a sequence of temperatures, with the interior temperature being the coldest. In order to provide the desired thermal isolation and yet at the same time provide a cryostat which may be readily transportable, even when filled with coolant, minimal mechanical contact between the various inner and outer cryostat vessels is required. Accordingly, a system of ties may be employed. These ties preferably comprise a low thermal conductivity material such as titanium or a glass fiber and epoxy composite. For example, a system of ties may include a set of at least three ties disposed on each end of an annular vessel. Each tie extends transversely from the outer vessel to an interior annular vessel thus providing a mechanical connection between the circumference of the outer vessel and the circumference of the inner vessel. A system of such ties is more particularly described below. However, the introduction of cryogens into the cryostat produces changes in dimension as a result of thermal contraction of the tie material and of the vessels themselves. Accordingly, ties have been required to have larger cross-sections to compensate for the thermal stresses that are present, in addition to stresses due to weight alone and stresses that arise from cryostat transport. However, it is generally undesirable to have a tie exhibiting a cross-sectional area larger than is necessary because of increased thermal conduction through the tie between the interior and exterior cryostat vessels. Accordingly, if the thermal contraction stresses could be eliminated, supporting ties could be employed which exhibit reduced cross-sectional areas and therefore provide greater thermal isolation for the inner cryostat vessel.

SUMMARY OF THE INVENTION

In accordance with a preferred embodiment of the present invention a cryostat assembly comprises an outer evacuable vessel with an annular shape; an interior vessel also having an annular shape is wholly contained within the outer vessel, each of these vessels being disposed so as to substantially share the same longitudinal axis. Furthermore, the cryostat of the present invention comprises a first set of at least three supporting ties disposed at one end of the cryostat and a second set of at least three supporting ties disposed at the other end of the cryostat. The supporting ties extend transversely from attachment points on the interior vessel to corresponding attachment points on the outer vessel, these attachment points preferably being substantially uniformly disposed around the periphery of the respective vessels. The sets of supporting ties at opposite ends of the cryostat are preferably disposed substantially in mirror image symmetry to each other with respect to a plane passing through the longitudinal axis of the cryostat. The transverse supporting ties act to maintain the outer and interior vessels in a spaced apart condition so that a vacuum may be maintained between them. Furthermore, the supporting ties comprise a material which exhibits both high tensile strength and low thermal conductivity, to minimize conductive thermal losses between the outer and interior vessels. The placement of the supporting ties in a mirror image symmetry configuration acts to prevent a rotational motion of the interior vessel about the longitudinal axis. Nonetheless, the supporting system of the present invention does provide a certain limited degree of relative axial motion between the interior and outer vessels. This axial freedom is a desirable aspect of the present invention in that it allows utilization of a structure which facilitates transportation of the cryostat, even under vacuum conditions with coolant in place. In particular, the structure of the cryostat of the present invention allows the interior vessel to be held against the outer vessel against a set of low thermal conductivity pins. In this way, the cryostat may be transported with vacuum conditions intact, with the longitudinal cryostat axis being oriented vertically. More importantly, with respect to the present invention, the anchor points of the ties, particularly the points on the interior vessel are selected to minimize stress increases in the ties that result from the introduction of cryogens into the cryostat and/or temperature gradients within the device. In particular, each of the ties is disposed so that the angle $\theta$, between the tie and a line drawn from its attachment point on the interior vessel to the common axis of said vessels is given by $\theta = \cos^{-1}(\Delta t/\Delta R)$, where $\Delta t$ is the thermal contraction length of the tie and $\Delta R$ is the thermal radial contraction length of the interior vessel. With this selection of anchor points, the stresses within the ties do not change at low temperature and the tie cross-sectional area may be selected to be optimal from the standpoint of minimal heat conduction while nonetheless providing the desired tensile strength.

Accordingly, it is an object of the present invention to provide a cryostat support tie configuration in which thermal contraction stresses within the ties are minimized.

It is another object of the present invention to provide ties for cryostat support which exhibit minimal cross sectional area to minimize conductive heat losses.

It is yet another object of the present invention to provide a cryostat for NMR medical diagnostic imaging which is readily transportable with vacuum conditions intact and with liquid cryogens installed.

It is yet another object of the present invention to provide a cryostat which is readily transportable either in a horizontal or vertical position.

Lastly, but not limited hereto, one of the objects of the present invention is the construction of a cryostat including a cryostat suspension system which is not only sturdy but which also provides a significant degree of thermal isolation between nested cryostat vessels.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

FIG. 7A is a partial cross-sectional, side elevation view illustrating the supporting tie attachment configuration for those ties connecting the exterior vessel and the intermediate (interior) vessel;

FIG. 7B is a view similar to FIG. 6A showing the supporting tie attachment configuration for those ties connecting the intermediate (interior) vessel with the innermost vessel;

FIG. 7C is a side elevation view of a side access port through which tension in the supporting ties may be adjusted.

DETAILED DESCRIPTION OF THE INVENTION

Figure 1:
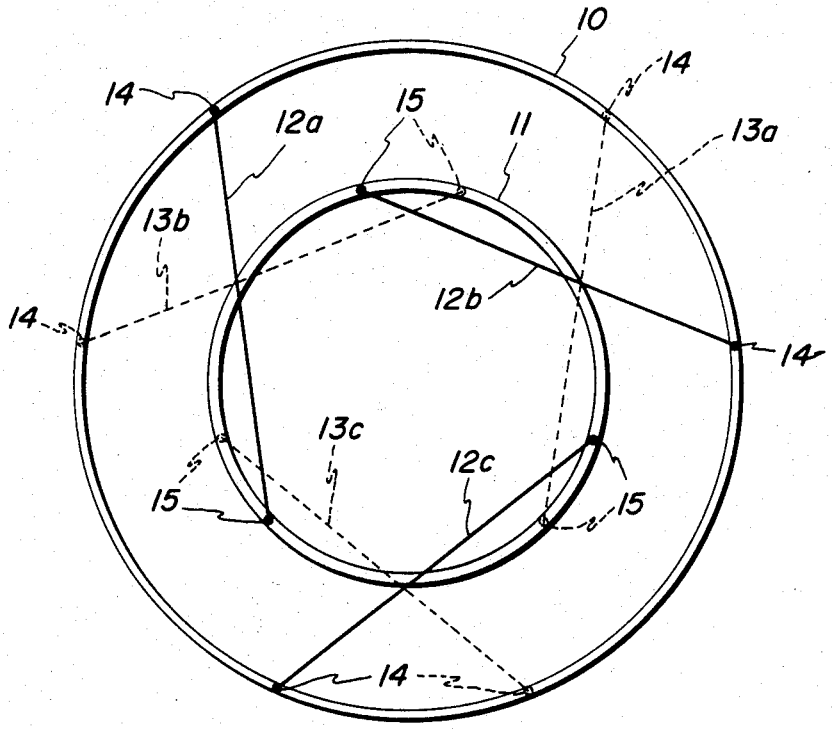
FIG. 1 is an end view, schematic diagram illustrating the essential principles involved in the suspension system of the present invention.
Figure 2:
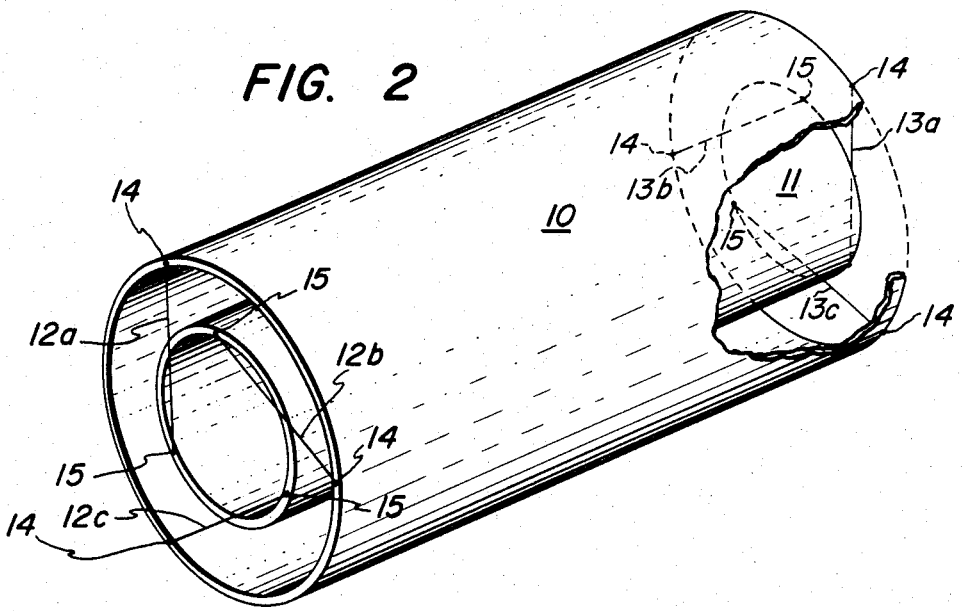
FIG. 2 is a partially cut-away isometric view of the suspension system with the end view illustrated in FIG. 1.
Figure 3:
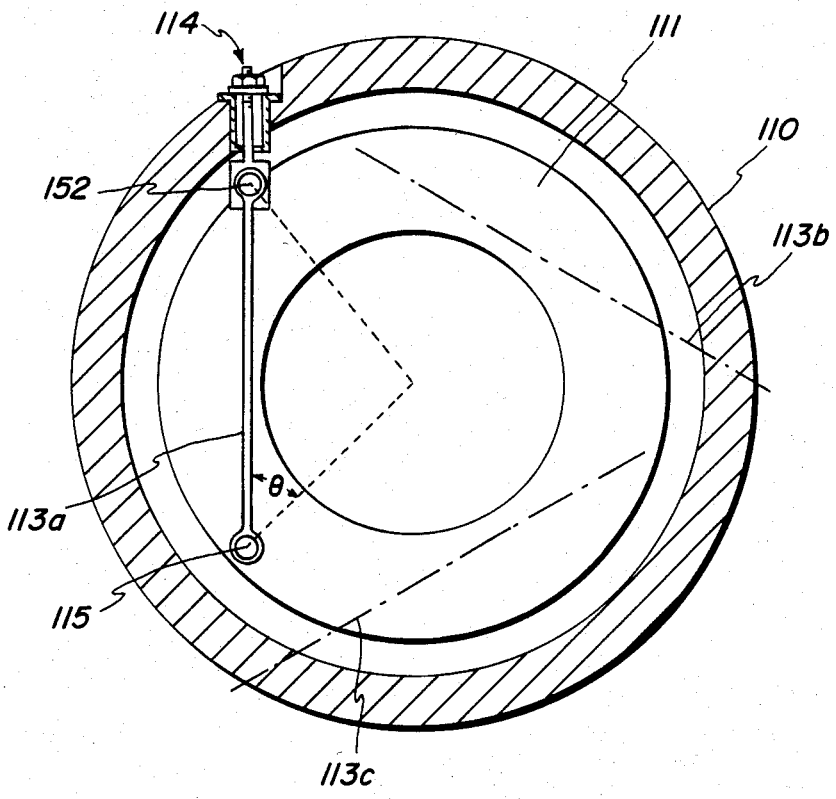
FIG. 3 is an end view diagram illustrating the suspension system of the present invention, particularly with respect to the angle $\theta$ considered below.

FIGS. 1 and 2 and especially FIG. 3 depict in a basic fashion the essential elements of the cryostat suspension system of the present invention. FIGS. 1 and 2 schematically illustrate a method for suspending one cylinder within another. However, the illustrations in FIGS. 1 and 2 are illustrative only and do not necessarily describe the tie configuration employed in the present invention. In general, in a cryostat one wishes to suspend the interior vessel in such a way that there is minimal physical contact between the inner and outer vessels. This permits the volume between the vessels to be evacuated and also provides thermal insulation. The only permanent mechanical connection between the inner and outer vessels of cylinders in the present invention is a system of high strength, low thermal conductivity ties. Such a system is illustrated in FIGS. 1, 2 and 3. In particular, FIG. 1 illustrates outer cylinder 10 in which inner cylinder 11 is suspended by means of a system of six supporting ties (three at each end). At one end of the cylinders, ties 12*a*, 12*b* and 12*c* extend in a transverse direction between attachment points 15 on cylinder 11 and attachment points 14 on outer cylinder 10. In the present invention these attachment points are more particularly constructed as described below. A corresponding set of supporting ties 13*a*, 13*b* and 13*c* is disposed at the other end of cylinders 10 and 11 and serve a similar function. However the supporting sets of ties at opposite ends of the cylinders are preferably configured in a mirror image symmetry pattern with respect to one another. In FIG. 1, the ties are symmetrical about a vertical line (not shown) passing through the cylinder axis. However, strict mirror symmetry is not required as long as one set of ties is disposed in a rotationally opposing direction with respect to the other set. Furthermore, attachment points may be located substantially uniformly about the periphery of cylinders 10 and 11. This configuration produces a relatively uniform distribution of stress in supporting ties. In a preferred embodiment of the present invention there are three supporting ties in each set. This preference is the result of two conflicting objectives. First, in order to provide maximal thermal insulation between the inner and outer cylinders, it is desired to have as few supporting ties as possible. Since it is highly desirable that the supporting ties exhibit minimal thermal conductance, it is therefore also generally desirable that the cross-sectional area of the ties be relatively small and that the ties themselves comprise material exhibiting low thermal conductivity. Even though the desire for thermal insulation in a supporting tie system seemingly suggests the utilization of supporting ties which would tend to lack tensile strength, such strength is often more readily provided by materials having undesirably high thermal conductivities and large cross-sectional areas. Accordingly, it is seen that the second competing requirement is that there be sufficient strength in the supporting ties to carry the weight of the inner cylinder. Furthermore, during transport of the assembly shown in FIGS. 1, 2 and 3, forces other than the weight of the cylinders can be produced which provide additional loads on the supporting tie system. Accordingly, the requirement of strength tends to indicate that a relatively large number of supporting ties is desirable. Since a system in which there are only two supporting ties in each set is insufficient to prevent certain transverse relative motions between the inner and outer cylinders, it is necessary to employ a system of ties in which there are at least three supporting ties at each end of the cylinder to be supported. While additional supporting ties would seem to be desirable to provide additional strength, judicious selection of the supporting tie material obviates the necessity for additional supporting ties. However, more ties could be provided if otherwise desired. In the selection of the materials for supporting ties 12*a*, 12*b*, 12*c*, 13*a*, 13*b* and 13*c*, high strength, low thermal conductivity material such as glass fiber, carbon or graphite composite or titanium are preferably employed. Such materials provide the requisite strength while at the same time exhibiting a low degree of thermal conductivity.

The material itself may be configured either in the form of a rod, loop or, as appropriate, a braided strand.

The view shown in FIG. 1, in end elevation form, is shown again in FIG. 2 in an isometric view so as to more clearly point out the structures provided at the ends of the cylinders. FIG. 1 on the other hand more clearly illustrates the uniform disposition of the attachment points and the opposed locational and mirror image relationship between the tie sets at opposite ends of the cylinders.

It should be appreciated that the suspension system illustrated in FIGS. 1, 2 and 3, while illustrating only a pair of nested cylinders, is equally applicable to a plurality of nested cylinders one lying within the other and all substantially sharing the same longitudinal axis. Accordingly, FIG. 3 particularly illustrates the suspension of vessel 111 within vessel 110, it should be understood that this is merely exemplary and that the remaining tie systems illustrated in FIGS. 4–7 are equally amenable to utilization of the principles embodied in the present invention.

In particular, the present invention relates to the selection of the angle $\theta$ illustrated in FIG. 3. The angle $\theta$ is the angle between the supporting tie and a line drawn from the interior anchor point 115 of the supporting tie to the common central axis. The angle $\theta$ is chosen, preferably by suitable positioning of anchor point 115 to be equal to $\cos^{-1}(\Delta t/\Delta R)$. Here $\Delta t$ is the change in length of the supporting tie (for example tie 113*a*) as a result of thermal contraction. It should be borne in mind that vessel 110 must be at an ambient temperature of 300° K. so that the anchor point 152 of the supporting tie remains always fixed in space, and that vessel 111 may be at a cryogenic temperature, for example 80° K. or below. Such temperatures and temperature differences result in contraction of the supporting tie system. Similarly, introduction of cryogens into vessel 111 for example, will cause vessel 111 to contract in a radial direction. Accordingly, the variable $\Delta R$ is the change in radius of vessel 111 which occurs as a result of the thermal contraction. Accordingly, it has been found that undesirable stresses can be induced in the supporting tie system as a result of thermal contraction effects. However, it has also been discerned that judicious placement of the supporting tie system, as determined by the thermal expansion and contraction parameters of the materials employed can serve to eliminate this source of tie stress. For example, by knowing the temperature to which the tie will be subjected and its composition, a value for $\Delta t$ is computed. Likewise, by knowing the operating temperature of vessel 111 and its material composition one can determine the value $\Delta R$. Using these two values the ratio $\Delta t/\Delta R$ is formed so as to determine the angle $\theta$ in accordance with the formula provided above.

For clarity, only supporting tie 113*a* is shown in FIG. 3. For supporting ties 113*b* and 113*c*, only their relative locations are indicated. Furthermore, while FIGS. 1, 2 and 3 illustrate certain fundamental aspects of the suspension system in the present invention, the remaining figures are provided to illustrate the utilization of the suspension system and its cooperation with other aspects of the present invention in a cryostat which is particularly useful for whole body NMR imaging. In particular, the cryostat illustrated in the remaining figures is particularly suited for maintaining a superconductive material at a temperature below the critical temperature so that persistent currents set up in electrical windings surrounding the bore of the cryostat act to produce a high strength, uniform magnetic field within the bore of the annular cryostat.

Figure 4:
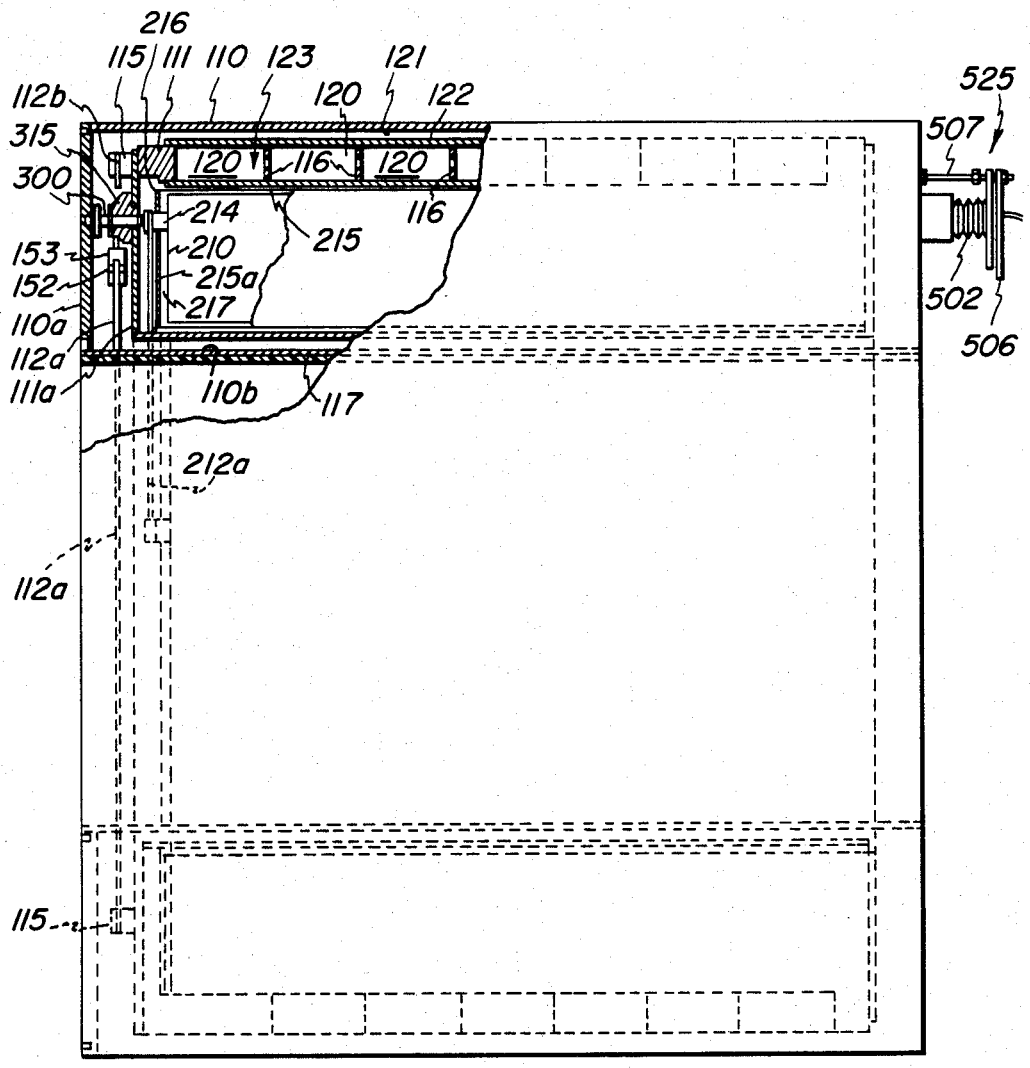
FIG. 4 is an partially cut-away, cross-sectional side elevation view of a cryostat of the present invention which is particularly useful for containing superconductive windings for the purpose of generating high strength magnetic fields for NMR imaging applications.

FIG. 4 is a partially cutaway, partially cross-sectional, side-elevation view of a cryostat in accordance with a preferred embodiment of the present invention. In particular, the cryostat of the present invention includes outer, evacuable vessel 110. Outer vessel 110 preferably possesses an annular shape and preferably possesses an inner bore diameter of approximately one meter for the purposes of whole body imaging. It is outer vessel 110 which provides support for the structures contained therein. Outer vessel 110 also includes end plates 110*a* disposed at each end thereof. Outer vessel 110 also possesses thin inner shell 110*b* that is preferably made of high electrical resistivity alloys such as Inconel X625. The thickness of inner shell 110*b* is typically between about 0.02 and 0.03 inches, and its high material resistivity (about $130\times10^{-6}$ ohm-cm) is selected so as to provide a short eddy current time constant (approximately 0.12 milliseconds) compared to the gradient field rise time (about 1 millisecond). The gradient fields are generated by coils (not shown) disposed within the annular bore of the cryostat. These coils do not form a material aspect of the present invention.

It is furthermore pointed out that the Inconel X625 inner shell makes excellent welded joints and accordingly, an all welded outer or exterior vessel is provided in the preferred embodiment of the present invention. Furthermore, to prevent buckling of inner shell 110*b*, fiberglass cylinder 117 may be inserted within the cryostat bore. In general, when the cryostat of the present invention is employed in conjunction with high strength magnetic fields, the various vessels shown in FIG. 4 typically comprise aluminum, except as otherwise noted herein, and except for outer vessel 110 which may comprise stainless steel, particularly for the reasons discussed above.

Figure 5A:
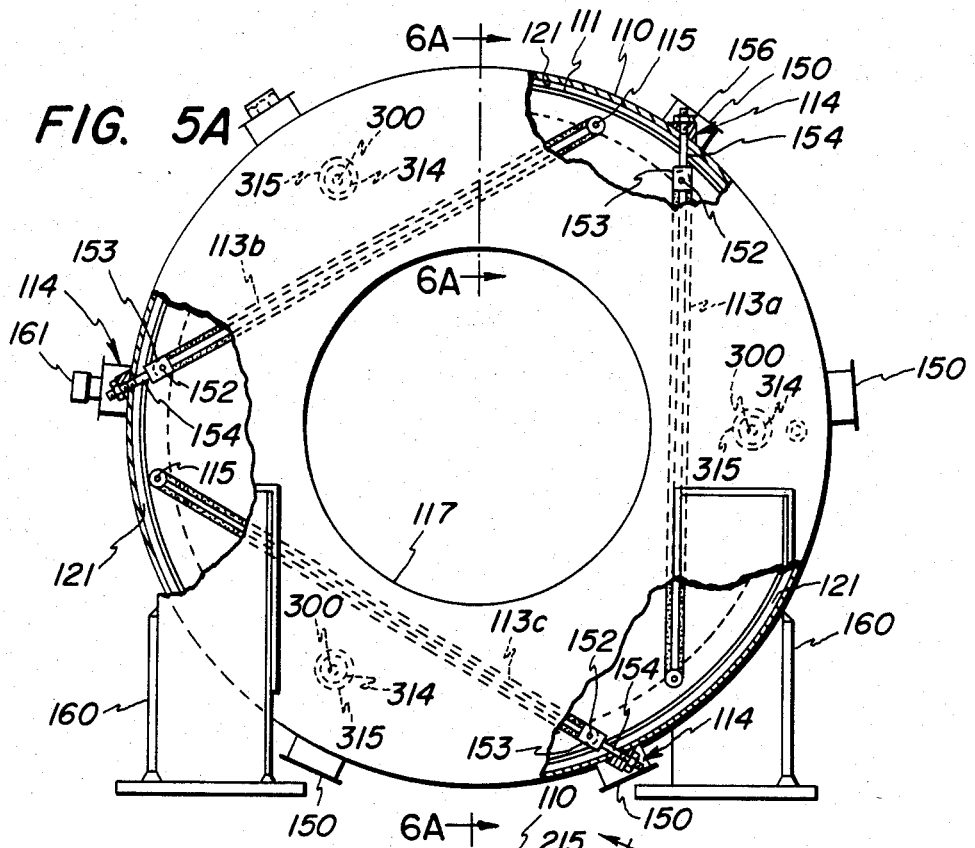
FIG. 5A is a partially cut-away, partially cross-sectional end view of the cryostat of FIG. 4 particularly illustrating the suspension of the interior vessel within an outermost vessel.
Figure 5B:
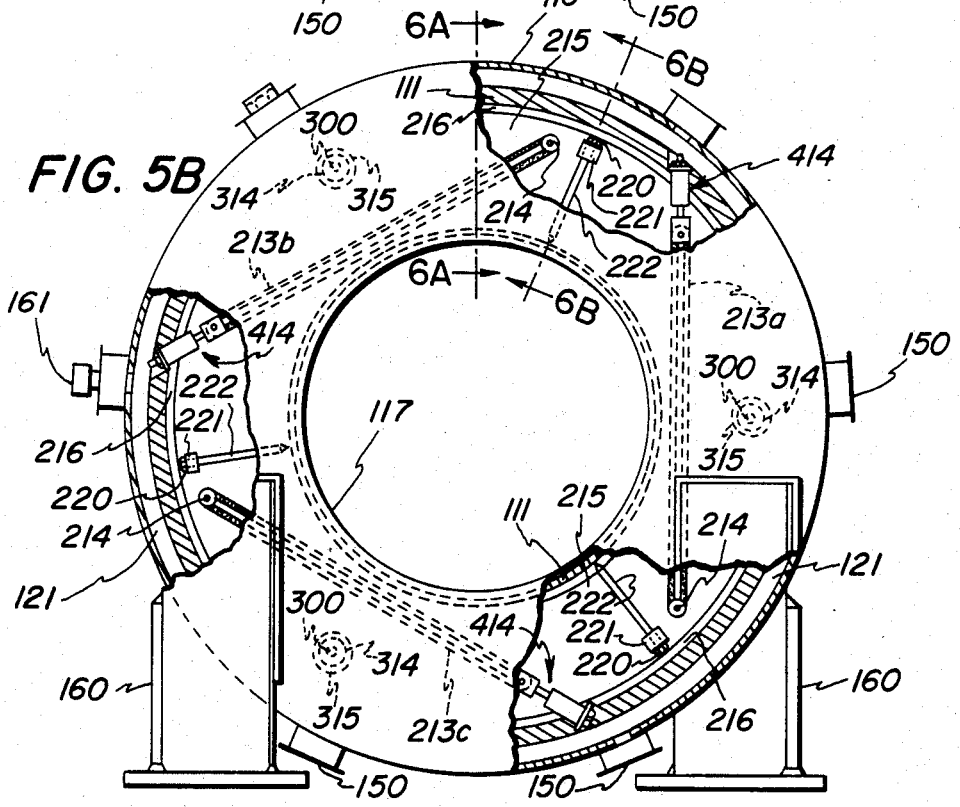
FIG. 5B is also a partially cut-away, partially cross-sectional end view of the cryostat of FIG. 4 more particularly illustrating the suspension of the innermost cryostat from the intermediate or interior vessel.

Because of some of the mechanical complexities of the apparatus of the present invention, the fullest appreciation thereof may best be had by a relatively simultaneous viewing of FIGS. 4, 5A, 5B, 6A and 6B. FIGS. 5A and 5B provide end views more particularly illustrating the suspension system. The side elevation, cross-sectional detail views of FIG. 6A and 6B more particularly illustrate the nesting of the various annular vessels employed.

FIG. 4 also illustrates interior vessel 111, having an annular configuration. In particular, it is seen that interior vessel 111 is suspended within outer vessel 110 by means of a system of supporting ties. In particular, supporting tie 112*a* is seen to be attached to a fixed point on vessel 110 by means of yoke 153. The other end of supporting tie 112*a* is connected to a boss 115 (seen in the lower portion of FIG. 4) on vessel 111. Boss 115 is typically welded to interior vessel 111. The supporting ties of the present invention preferably comprise titanium rods, graphite or carbon fiber composites or glass fiber material. In particular, the supporting ties of the present invention are shown as loops or rods of appropriately selected material. The loops are held in place in boss 115 by means of circular channels therein. Additionally, it is also seen for example, that supporting tie 112*a* is held in position within yoke 153 by means of pin 152, which may be force fit into corresponding circular apertures in the side of yoke 153. FIG. 3 also illustrates that vessel 111 is supported by means of supporting tie 113*b* (which is partially visible) disposed about upper boss 115. Supporting tie 113*b* is attached at its other end, (not visible) to outer vessel 110. Accordingly, it is seen that outer vessel 110 and interior vessel 111 thereby define volume 121 which is evacuable to provide the desired degree of thermal isolation between ambient and internal temperature conditions.

Interior vessel 111 preferably comprises a material such as aluminum and preferably exhibits an all-welded construction. Interior vessel 111 also preferably possesses outer jacket 123 which defines an annular volume 120 for containing a coolant such as liquid nitrogen. Additionally, multilayer insulation 122 may also be disposed around vessel 111 for the purpose of reducing radiative heat transfer. Accordingly, vessel 111 acts as a thermal radiation shield which is maintained at a temperature of approximately 77° K. Jacketed shield 111 is actively cooled by the boiling of liquid nitrogen that is disposed within shield outer jacket 123. Outer jacket 123 also preferably includes perforated baffles 116, for additional strength and rigidity against buckling which may develop as a result of vacuum conditions.

Figure 6B:
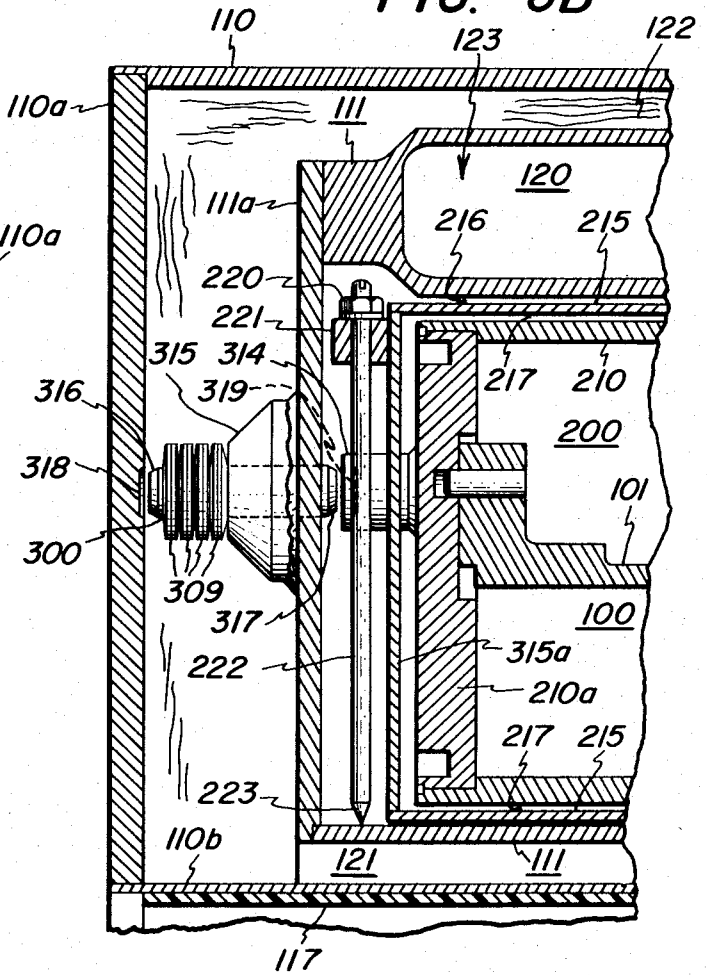
FIG. 6B is a cross-sectional, side elevation view of a portion of the cryostat of FIG. 4 which illustrates in detail one of the pins which is employed to assist in positioning the interior vessel in a fixed axial position, and which also illustrates a suspension system for a shield between the innermost vessel and the interior vessel.

An additional thermal radiation shield 215 may be provided within the annular volume of vessel 111. Thermal radiation shield 215 is not illustrated in detail in FIG. 4. However, FIG. 6B illustrates, in detail, the mechanism for positioning this shield.

Finally, FIG. 4 illustrates innermost vessel 210 suspended wholly inside radiation shield 215. The construction of innermost vessel 210 may be more readily discerned from FIGS. 6A and 6B. However, FIG. 4 is sufficient to illustrate, at least partially, the mechanism for suspending innermost vessel 210 within shield 215 and within interior vessel 111. In particular, boss 214, which is preferably welded to innermost vessel 210 is seen to extend through shield 215 (see FIGS. 5B, 6B and 6A). Boss 214 is seen to provide an attachment point for supporting tie loop 212*a*. The other end (not shown) of supporting tie 212*a* is attached to vessel 111.

Also partially visible in FIG. 4 is a transport or shipping and penetration mechanism 525 which functions to hold vessels 110, 111 and 210 in a fixed axial position during cryostat transport. It is noted here, however, that the apparent alignment of pin 300 with boss 214 in FIG. 3 is merely an effect of perspective. A better appreciation of the position of pin 300 and boss 214 may be had from the view presented in FIG. 5B.

FIG. 5A is a partially cut-away end view of a cryostate in accordance with the present invention. In which the system for suspending interior vessel 111 within outer vessel 110 is particularly illustrated. In particular, it is seen that supporting ties 113*a*, 113*b* and 113*c* extend from bosses 115 on vessel 111 to corresponding attachment points 114 on exterior vessel 110. Exterior vessel 110 may, if desired, be supporting on pedestals 160. A detailed description of attachment point 114 structure may be found in the discussion below with respect to FIG. 7A. In FIG. 5A, boss 115 is seen attached to interior vessel 111. The suspension system shown maintains outer vessel 110 and interior vessel 111 in a spaced-apart position so as to define volume 121 therebetween. However, it is noted that, in general, the interior region of vessel 110 is maintained in an evacuated condition. This condition is maintained by coverplates 150 which cover access ports which are used for tensioning the supporting ties, particularly during assembly. Vacuum conditions may, for example, be produced through vacuum seal off 161. Additionally, transporter shipment pins 300 are shown in phantom view in FIGS. 5A and 5B. In fact, FIGS. 5A and 5B are the figures which best illustrate the positioning of these pins. Also shown in phantom view is boss 315 which is affixed to interior vessel 111. Also shown in phantom view, is boss 314 which is attached to innermost vessel 210 and which extends through radiation shield 215. An additional view of the support structure as seen in FIG. 6B which is a cross-sectional representation along the corresponding lines shown in FIG. 5B. Furthermore, cross-sectional line 6A is also shown in FIG. 5 and corresponds to FIG. 6A which is more particularly discussed below.

While FIG. 5A illustrates the suspension of vessel 111 within exterior vessel 110, FIG. 5B is provided to more particularly illustrate the suspension of innermost vessel 210 within interior vessel 111. As above, interior vessel 111 is preferably a jacketed vessel possessing outer jacket 123. However, jacket 123 is not visible in the sectional view of FIG. 5A. Additionally, innermost vessel 210 is also not visible because of the presence of surrounding thermal radiation shield 215. While it could appear that boss 214 is attached to shield 215, in actuality, boss 214 is affixed to end plate 210*a* of innermost vessel 210 (see FIG. 6A). Supporting ties 213*a*, 213*b* and 213*c*, are employed to suspend vessel 210 from interior vessel 111. Supporting ties 213*a*, 213*b* and 213*c* extend from bosses 214 to attachment points 414 on interior vessel 111. The detailed construction of these attachment points is more particularly illustrated in FIG. 7B discussed below. Accordingly, it is seen that there is defined volume 216 disposed between radiation shield 215 and interior vessel 111. As above, this is preferably an evacuable volume, the evacuation being performed through seal 161. Additionally shown in FIG. 5B is a mechanism for suspending thermal radiation shield 215 from the interior wall portion of interior vessel 111. This suspension system is more particularly shown in FIG. 6B, discussed below. FIG. 6B is a cross-sectional view through the line illustrated in FIG. 5B. It is also noted that adjustment for tension in supporting ties 213*a*, 213*b* and 213*c* is effected through removal of cover plates 150.

Figure 6A:
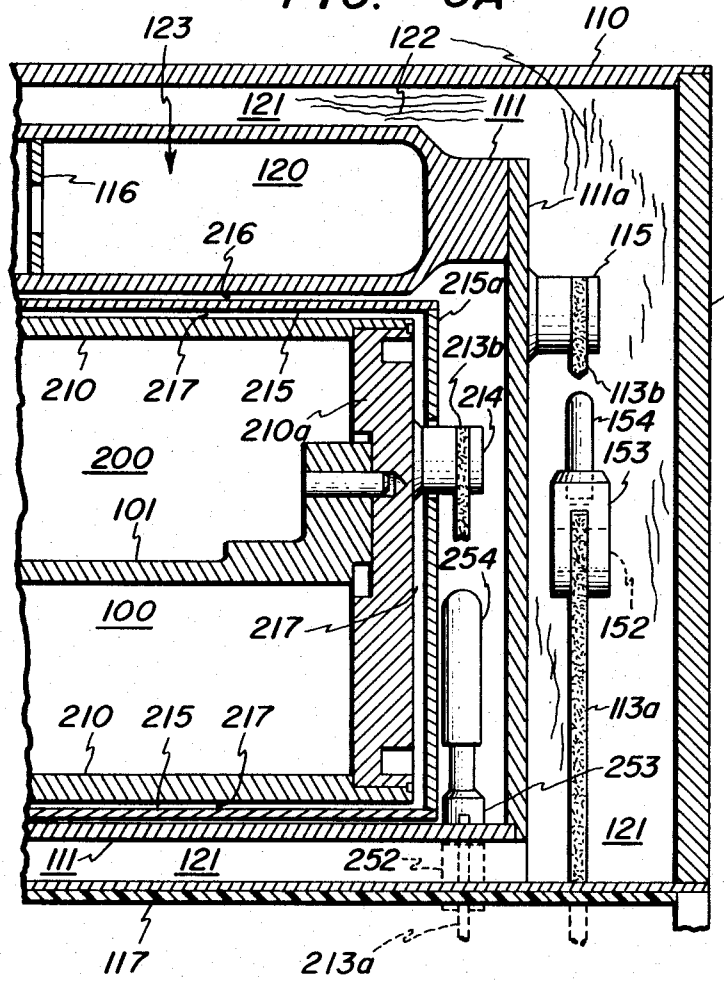
FIG. 6A is a cross-sectional, side-elevation view of a portion of the cryostat of FIG. 4, which more particularly illustrates the suspension system for the interior vessel and the innermost vessel.

FIG. 6A is a cross-sectional side elevation view through the line shown in FIGS. 4 and 5. However, for clarity, the suspension system for thermal shield 215 is omitted from this view. However, it is shown in FIG. 6B discussed below. The suspension system for innermost vessel 210, interior vessel 111 and exterior vessel 110 is nonetheless particularly illustrated in the view of FIG. 6A. In particular, supporting tie 113*a* is seen disposed about pin 152 in yoke 153 which is attached to partially threaded shaft 154 which extends through the wall of exterior vessel 110. The portion of shaft 154 extending beyond the wall of exterior vessel 110 is particularly illustrated in FIG. 7A. Additionally, supporting tie 213*a* (in phantom) is seen disposed about pin 252 (also in phantom) which extends through yoke 253, which in turn is attached to shaft 254 which extends through the wall of interior vessel 111. The portion of shaft 254 which extends through this wall is seen in FIG. 7B. Also shown in FIG. 6A is boss 115 which is attached to end plate 111*a* of interior vessel 111 and is employed as an attachment point for supporting tie 113*b*. In a like manner, boss 214 is shown attached to end plate 210*a* of innermost vessel 210 and extends through end plate 215*a* of thermal radiation shield 215. Boss 214 serves as an attachment point for supporting tie 213*b*, only a portion of which is shown, for purposes of clarity.

In those applications in which the present invention is particularly desired in the generation of high intensity magnetic fields produced by superconductive windings, innermost vessel 210 is further divided into annular volumes 100 and 200, as shown, by means of cylindrical shell 101 which is disposed therein. In such cases volume 100 contains electrical windings comprising superconductive material. Volume 200 is typically filed with a low temperature coolant such as liquid helium. Penetration assembly 525 provides means for introducing liquid coolant into volume 200.

FIG. 6B is a cross-sectional side-elevation view taken along the cross sectional line shown in FIG. 5B. However, for purposes of clarity, boss 214 and supporting tie 213*b* are not shown in FIG. 6B. FIG. 6B is particularly relevant for illustrating two facets of a preferred embodiment of the present invention. In particular, the transport or shipping pin system is shown in detail. Additionally, means for positioning thermal radiation shield 215 is shown. As noted above, the suspension system in the present invention prevents axial motion of interior vessel 210 in an axial direction. Typically, movement of approximately ¾ of an inch is permitted. This movement is accomplished by means of a transport rod inserted into penetration assembly 525. The resultant axial motion moves transport pin 300 having beveled edges 316 and 317 into contact with mating recess 318 in end plate 110*a* of exterior vessel 110. Transport pin 300 is also disposed through and affixed through boss 315 and extends through end plate 111*a* of interior vessel 111. The axial motion also causes contact between beveled end 317 of pin 300 and a correspondingly shaped aperture 319 in boss 314 which is affixed to end plate 210*a* of innermost vessel 210. As noted above, boss 314 extends through an aperture (not visible) in end wall 215*a* of radiation 215. Additionally, pin 300 may be provided may be provided with Belleville washers 309 to absorb impacts due to shock loading during transport and to assist in returning the assembly to its normal axial alignment position after transport. Pins 300 typically comprise a material such as titanium which exhibits high compressive strength but low thermal conductivity. Furthermore, it is also possible to employ pins comprising glass fiber material and more particularly to employ glass fiber pins in which the ends are not beveled. This latter embodiment of the present invention does not employ apertures such as 318 or 319 into which pin 300 is disposed during transports. This configuration is particularly desirable in those situations in which it is desirable to avoid the necessity of precise positioning of the pin assembly so that alignment between the pins and the beveled apertures into which they may be inserted is not a problem. In the embodiments shown however, proper dimensioning of the transport system may be provided to assure proper pin alignment.

FIG. 6B is also relevant in that it shows a system for suspending thermal radiation shield 215 from interior vessel 111. In particular, it is seen that a plurality of circumferentially disposed bosses 221 are attached to thermal radiation shield 215. Through these bosses there is disposed a partially threaded rod 222 having pointed tip 223. Tip 223 rests on the inner surface of interior vessel 111 and helps to provide minimal thermal conduction through rod 222. Rotation of threaded rod 222 is employed to position radiation shield 215, the position being locked in place by means of nut 220. Rod 222 comprises a low thermal conductivity material such as glass fiber, titanium or a boron or graphite composite. The placement of rod 222 is also particularly seen in FIG. 5B. Additionally, it is seen that radiation shield 215 and innermost vessel 210 define volume 217 disposed therebetween.

Outer attachment points 114 for the suspension of interior vessel 111 are shown in detail in FIG. 7A. In particular, supporting tie 113*c* is seen disposed about pin 152 in yoke 153 which is attached, as by thread means for example, to shaft 154 which extends through the outer wall of exterior vessel 110. Shaft 154 is also disposed through exterior boss 155 in which it is held by nut 156 by which means the tension in supporting tie 113*c* may be adjusted. Shaft 154 extends into a volume defined by the outer wall of vessel 110, circular tension access port housing 151 and access port cover 150. This exterior housing structure is constructed to be air tight so as to preserve interior vacuum conditions.

In a similar fashion, supporting tie 213*c* is disposed about pin 252 in yoke 253 possessing a threaded shaft 254 which extends through interior vessel 111. Tension in shaft 254 is fixed by means of adjustable nut 256. Additionally, Belleville washers 258 are preferably provided. Access to nut 256 is available through aperture 257 in the wall of exterior vessel 110. Access to aperture 257 is provided through access port housing 151. The configuration of tensioning nuts 156 and 256 may also be appreciated from the bottom, nonsectional view in FIG. 7C in which the same objects are seen to possess corresponding reference numerals.

Multilayer insulation 122 may also be provided around the exterior of liquid nitrogen cooled interior vessel 111 to reduce radiation heat transfer. Only one layer of such insulation, however, may be inserted in volume 216 between liquid nitrogen cooled vessel 111 and helium cooled shield 215. Additionally, only one layer of such insulation may be disposed in volume 217 between helium cooled shield 215 and the innermost vessel 210 to reduce the emissivity of these surfaces.

Another aspect of the present invention is the provision for an exterior vessel 110 which comprises an all-welded design. This is facilitated by the employment of innerwall 110*b* for vessel 110 comprising Inconel X625, which makes excellent welded joints to dissimilar metals such as 300 series stainless steels. As discussed above, prevention of buckling in wall 110*b* is facilitated by the insertion of glass fiber cylinder 117.

From the above, it may be appreciated that the present invention provides a cryostat which fully and capably meets the objects expressed above. In particular, it is seen that the tie support system of the present invention exhibits desirable properties with respect to thermal expansion and contraction due in particular to the introduction of cryogenic materials into the various vessels employed. It is seen that the supporting tie configuration of the present invention provides for the utilization of supporting ties exhibiting smaller cross-sectional areas because of the reduced stresses which they undergo in the present invention. This is particularly advantageous since supporting ties with a greater thermal resistance may be employed to more effectively isolate one vessel from another.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A cryostat comprising:

an outer, evacuable vessel having an annular shape;

an interior vessel having an annular shape and being wholly contained within said outer vessel so that the central axes of said interior vessel and said outer vessel lie substantially along the same line;

a first set of at least three supporting ties extending transversely from attachment positions on a first end of said interior vessel to corresponding attachment points on the proximal end of said outer vessel, said attachment points on said first end of said interior vessel being substantially uniformly disposed about the periphery thereof and said corresponding attachment points on said outer vessel being substantially uniformly disposed about said outer vessel; and a second set of at least three supporting ties extending transversely from attachment points on a second end of said interior vessel to corresponding attachment points on the proximal end of said outer vessel, said attachment points on said second end of said interior vessel being substantially uniformly disposed about the periphery thereof and said corresponding attachment points on said outer vessel being substantially uniformly disposed about said outer vessel;

said first and second set of said supporting ties each being disposed so that the angle $\theta$ between said tie and a line drawn from its attachment point on said interior vessel to said axis is given by $\theta = \cos^{-1}(\Delta t/\Delta R)$, where $\Delta t$ is the thermal contraction length of said tie and $\Delta R$ is the thermal radial contraction length of said interior vessel.

2. The cryostat of claim 1 in which said supporting ties comprise glass fiber.

3. The cryostat of claim 2 in which said interior vessel includes an outer jacket for the containment of liquid coolant.

4. The cryostat of claim 1 in which said supporting ties comprise titanium.

5. The cryostat of claim 1 further including means for adjusting tension in said supporting ties.

* * * * *